United States Patent [19]

Jones et al.

[11] Patent Number: 4,782,887

[45] Date of Patent: Nov. 8, 1988

[54] ROLLING DOOR DRIVE ASSEMBLY

[75] Inventors: Richard E. Jones, Carlingford; Mitchell J. Billows, Bankstown, both of Australia

[73] Assignee: Byrne & Davidson Doors (N.S.W.) Pty. Limited, Revesby, Australia

[21] Appl. No.: 4,981

[22] Filed: Jan. 20, 1987

[30] Foreign Application Priority Data

Apr. 15, 1986 [AU] Australia ..... PH5471

[51] Int. Cl.[4] ..... E06B 9/204

[52] U.S. Cl. ..... 160/310; 160/133

[58] Field of Search ..... 160/310, 311, 312, 133, 160/188, 189, 193; 74/625, 405

[56] References Cited

U.S. PATENT DOCUMENTS 4,172,563 10/1979 Werner et al. ..... 160/310 X
4,342,354 8/1982 Leivenzon et al. ..... 160/310 X
4,392,392 7/1983 Perisic et al. ..... 160/319 X
4,411,348 10/1983 Fillion ..... 160/310 X
4,644,813 2/1987 Whitehouse et al. ..... 160/310 X

*Primary Examiner*—Ramon S. Britts
*Assistant Examiner*—David M. Purol
*Attorney, Agent, or Firm*—Pennie & Edmonds

[57] ABSTRACT

A rolling door drive assembly including a chassis, a final drive unit rotatably mounted to the chassis for operating the door, a motor fixed with respect to the chassis, a drive device interconnecting the motor and the final drive unit, a housing defining a mounting channel on the assembly remote from the final drive unit, the mounting channel extending transversely to the axis of rotation of the final drive unit and adapted to receive part of a mounting bracket, and a mounting member extending into the mounting channel in a direction parallel to the axis for engagement with the mounting bracket.

7 Claims, 10 Drawing Sheets

ROLLING DOOR DRIVE ASSEMBLY

The present invention relates to an improved means for driving rolling doors. In particular, it provides an improved mounting system for securing the drive means to the door.

Rolling doors are well known and comprise a flexible door curtain which can be raised and lowered from a drum located above the door aperture. It is well known to employ a pair of end drums rotatably mounted on a fixed axle extending horizontally across the top of the door aperture. The curtain is secured at its upper end to each of the spaced end drums, one of which engages a ring gear which may be provided with a motor drive for rotating the drum and thereby raising or lowering the door.

It is well known to employ power drive units, with or without drive release means. One such prior art drive unit is disclosed in Australian Patent specification No. 519,424.

A new and improved drive unit is described in our co-pending Australian Patent Application filed concurrently with this application and entitled "Releasable Drive Assembly". The text of this co-pending application is incorporated herein by way of reference. The preferred embodiment of our co-pending application is identical to that described herein. However, that application is directed primarily to the drive means itself and its drive release features, while the present application is directed primarily to its improved mounting aspects.

The prior art unit described in Australian Patent specification No. 519,424 is mounted directly to the fixed axle by means of opposed clamp jaws. It was important to ensure that the unit was very securely clamped in order to avoid relative rotation.

The prior art unit also required a relatively large amount of clear space at the side of the door. This frequently meant that the unit could not be used in cases of reduced side clearance. It was also not readily adaptable to right and left hand installations and was not easily fitted to existing doors.

It is an object of the present invention to provide a rolling door drive assembly which is adapted for use in cases where the above-mentioned prior art unit would have been excluded by reduced side clearance.

It is an object of a preferred embodiment of the invention to provide an assembly which can be readily fitted to either end of a rolling door.

According to the invention there is provided a rolling door drive assembly comprising a chassis, a final drive unit rotatably mounted to said chassis for operating said door, a motor fixed with respect to said chassis, drive means interconnecting said motor and said final drive unit, housing means defining a mounting channel on said assembly remote from said final drive unit, said mounting channel extending transversely to the axis of rotation of said final drive unit and adapted to receive part of a mounting bracket, mounting means extending into said mounting channel in a direction parallel to said axis for engagement with said part of said mounting bracket.

Preferably, the drive means includes a clutch for releasing and re-engaging the motor and the final drive unit, handle means being provided for manually operating the clutch, the housing means defining a handle channel extending at right angles to both the mounting channel and the axis, at least part of the handle channel being adapted to receive the handle means for movement within the handle channel.

In a further preferred form of the invention the handle means includes a hand grip unit which is removable from the assembly or at least rotatable out of register with the handle channel, thereby permitting access to the mounting means along the handle channel.

The housing means and chassis may be separate or integral. Preferably, the mounting means is integral with the chassis.

A preferred embodiment of the invention will now be described, by way of example only, with reference to the accompanying drawings in which.

Figure 8:
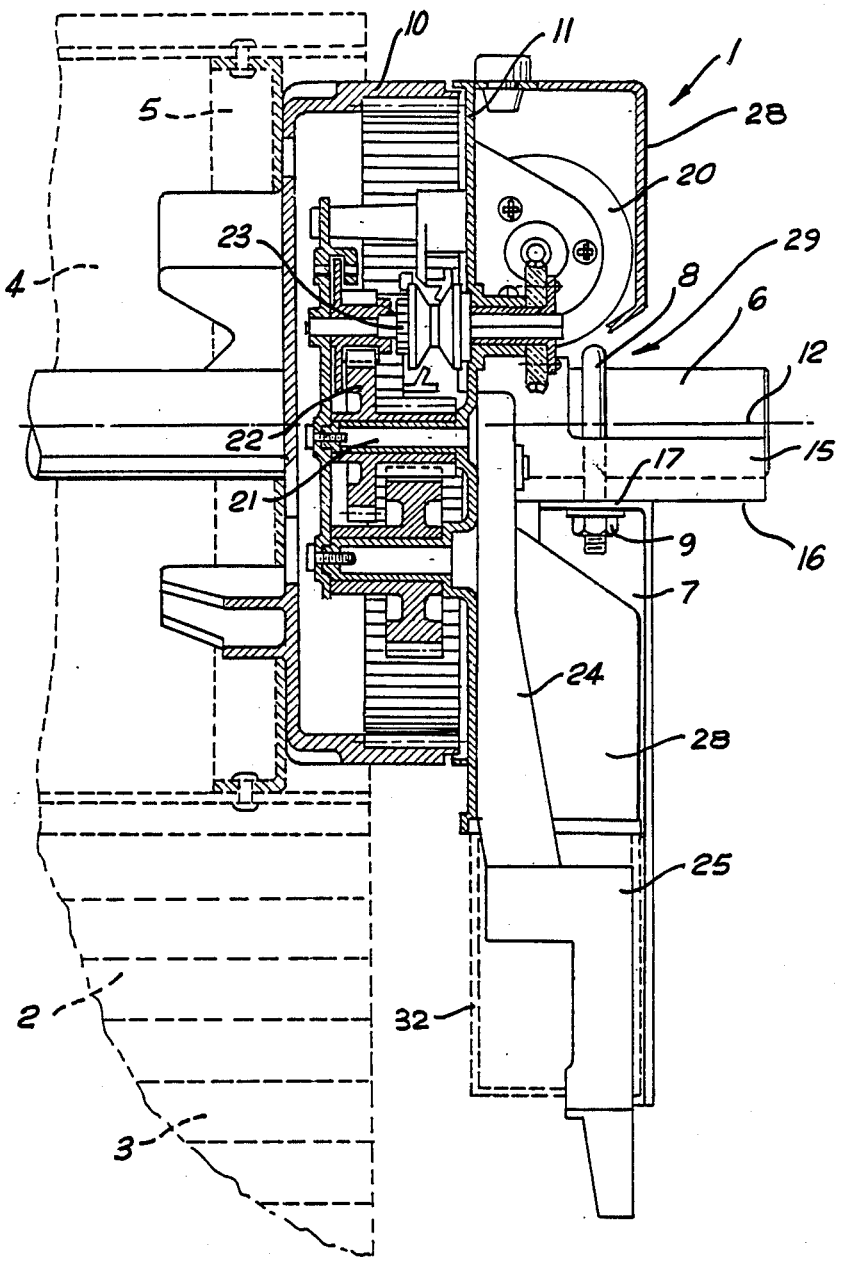
FIG. 8 is a sectional side elevation taken on line 8—8 of FIG. 7, showing the assembly attached to a rolling door.
Figure 9:
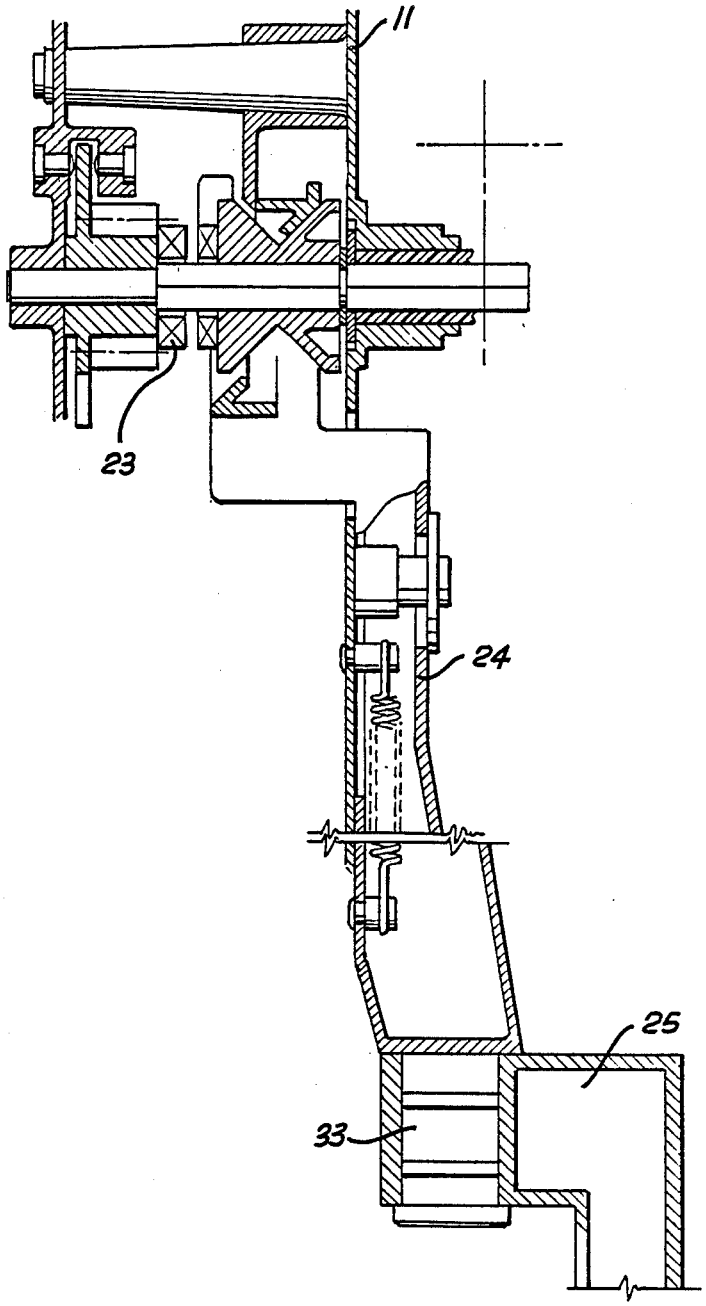
FIG. 9 is an enlarged view of part of the assembly shown in FIG. 8.
Figure 11:
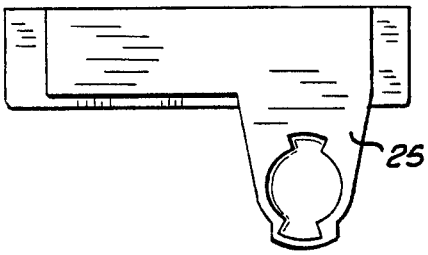
FIG. 11 is a plan view of the hand grip unit shown in FIG. 10.
Figure 12:
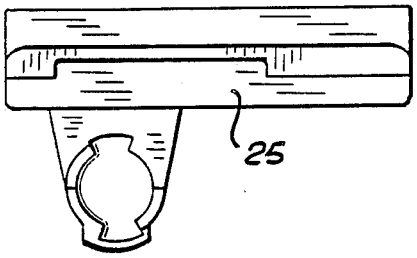
FIG. 12 is an underside view of the hand grip unit shown in FIG. 10.
Figure 10:
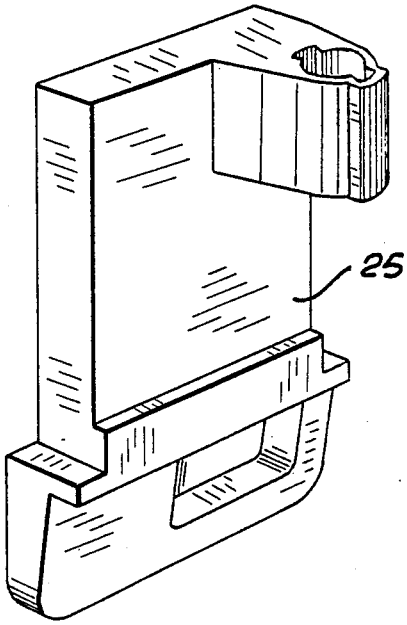
FIG. 10 is a perspective view of a hand grip unit.
Figure 13:
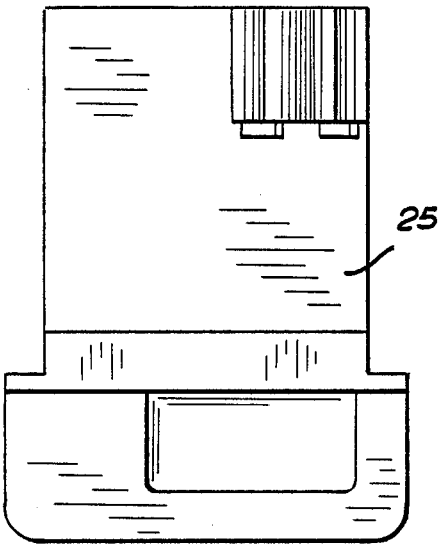
FIG. 13 is a rear view of the hand grip unit shown in FIG. 10.
Figure 15:
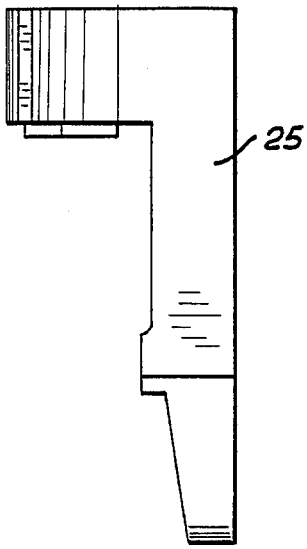
FIG. 15 is a side view of the hand grip unit shown in FIG. 10.
Figure 14:
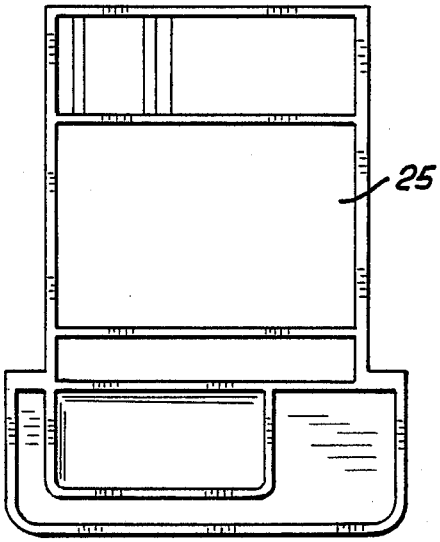
FIG. 14 is a front view of the hand grip unit shown in FIG. 10.
Figure 16:
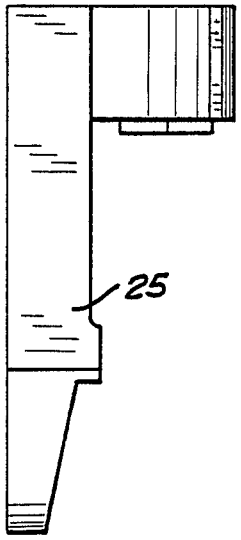
FIG. 16 is an opposite side view of the hand grip unit shown in FIG. 15.

Referring initially to FIG. 8 of the drawings, the rolling door drive assembly 1 is shown attached to a rolling door 2. The rolling door 2 includes a flexible door curtain 3 which can be raised or lowered from a drum 4 located above the door aperture. The drum 4 is defined by a pair of end drums 5 of which only one is shown. The end drums are rotatably mounted on a fixed axle 6 extending across the top of the door aperture. The axle is secured at its opposite ends to mounting brackets 7 by means of U-bolts 8 and locking nuts 9.

The drum 4 is rotated by a ring gear 10 which engages the end drum 5 and forms the final drive unit of the drive assembly.

Referring more particularly to the drive assembly itself, this includes a chassis 11 which rotatably supports the ring gear 10 for rotation about axis 12. The chassis is rigidly secured to the mounting bracket 7 by a projecting mounting lug 15 which is sandwiched between the bracket 7 and axle 6 by U-bolt 8. The mounting lug 15 has a flat base 16 for non-rotatable locking engagement with the top flange 17 of the mounting bracket 7. The mounting lug 15 also includes axially extending elongate slots 18 for adjustably receiving the U-bolt 8.

Figure 1:
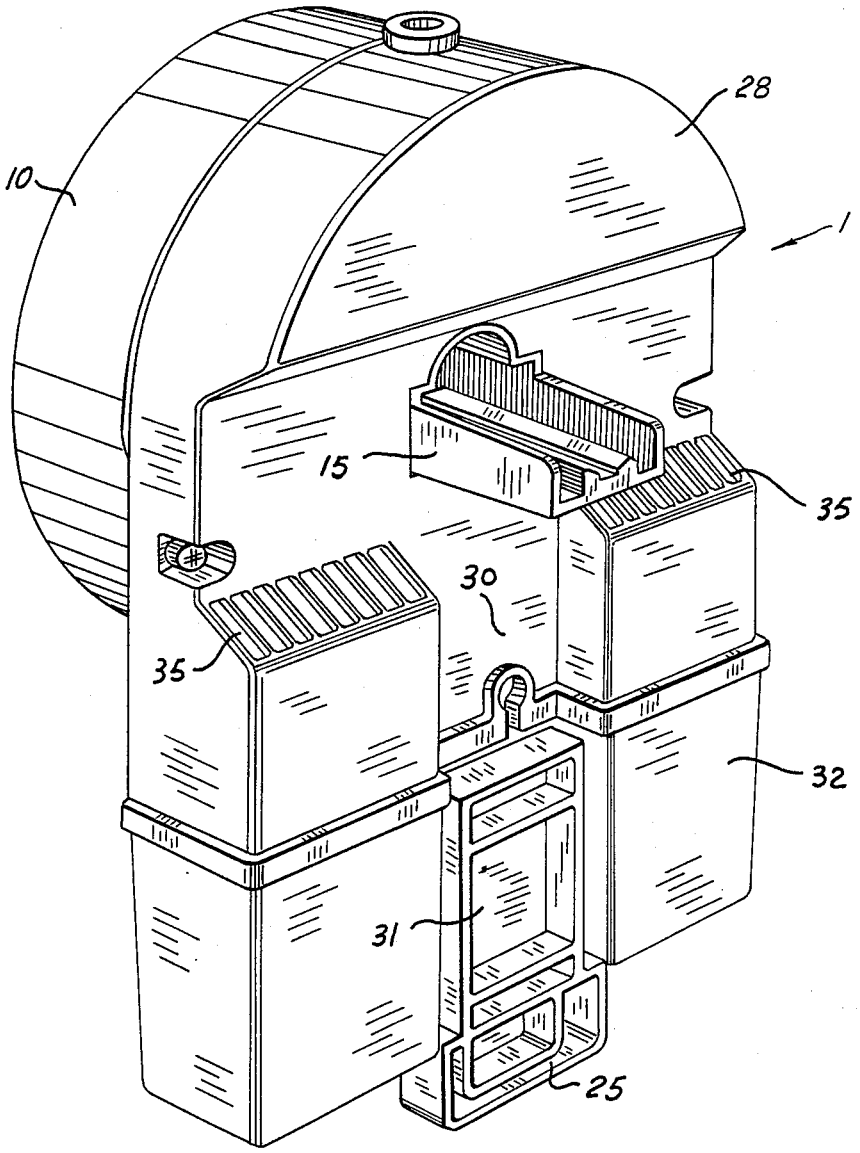
FIG. 1 is a perspective view of a drive assembly according to the invention.
Figure 2:
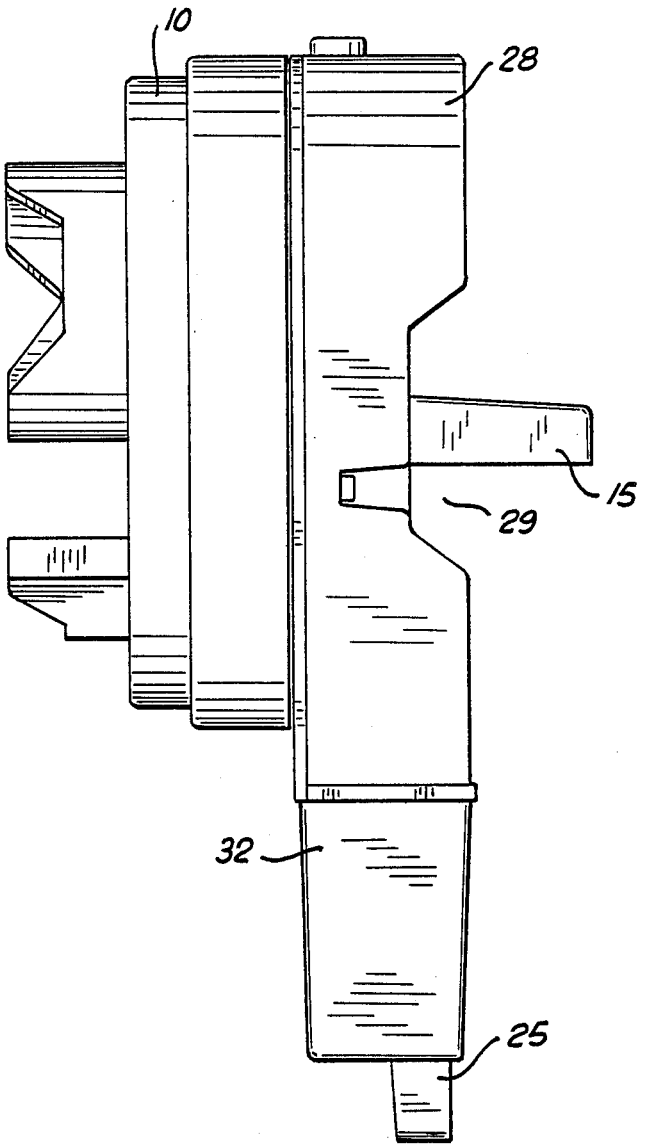
FIG. 2 is a side elevation of the drive assembly shown in FIG. 1.
Figure 3:
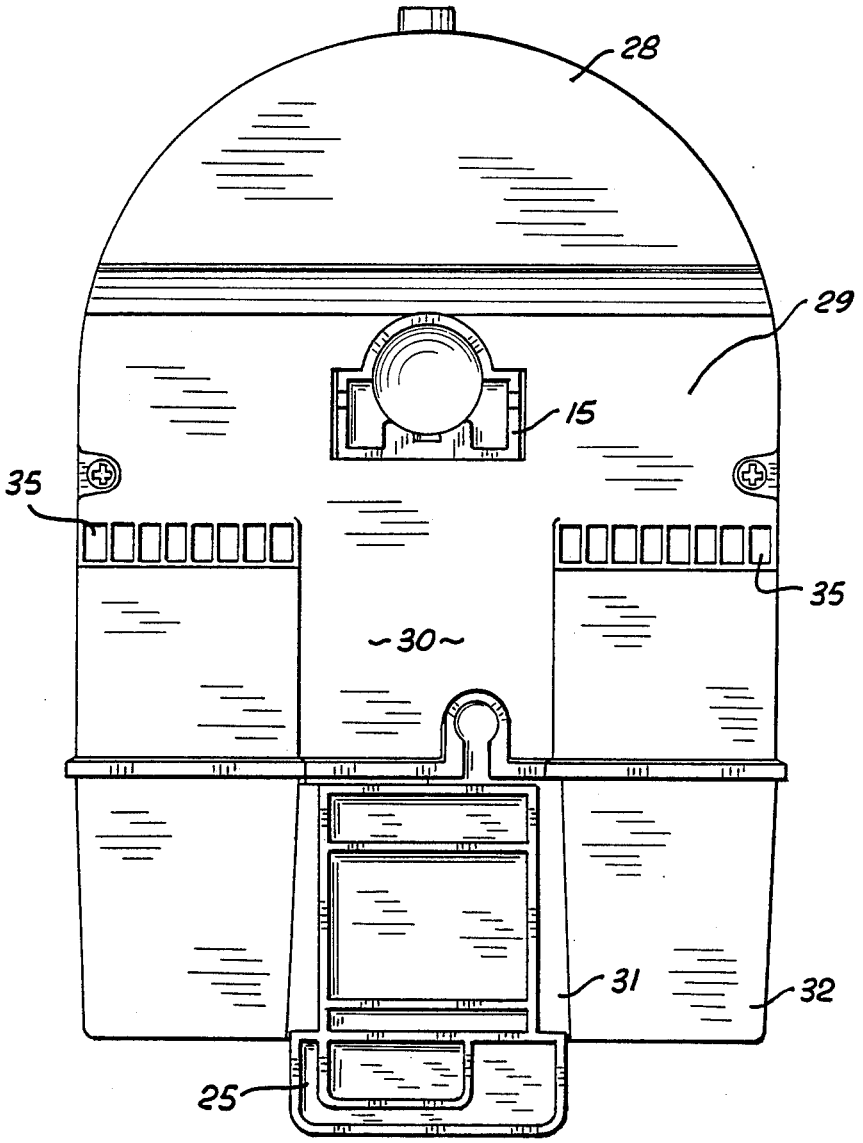
FIG. 3 is an front elevation of the assembly shown in FIG. 1.
Figure 4:
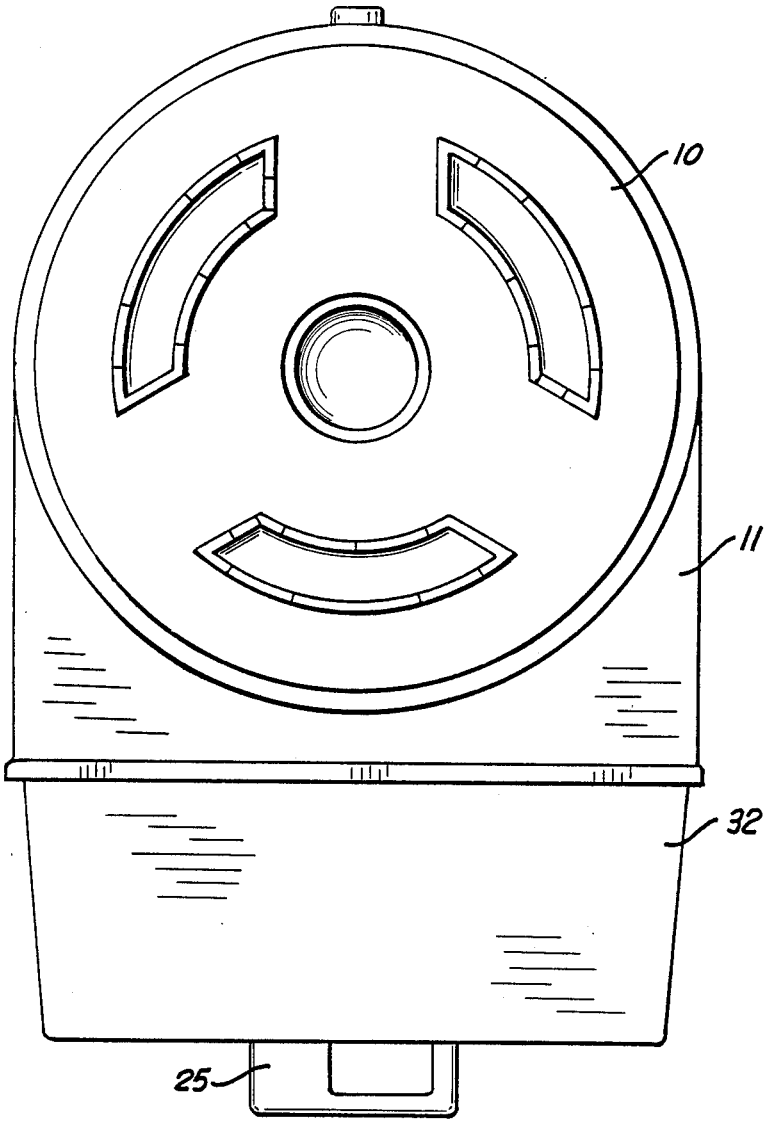
FIG. 4 is a rear elevation of the assembly shown in FIG. 1.
Figure 5:
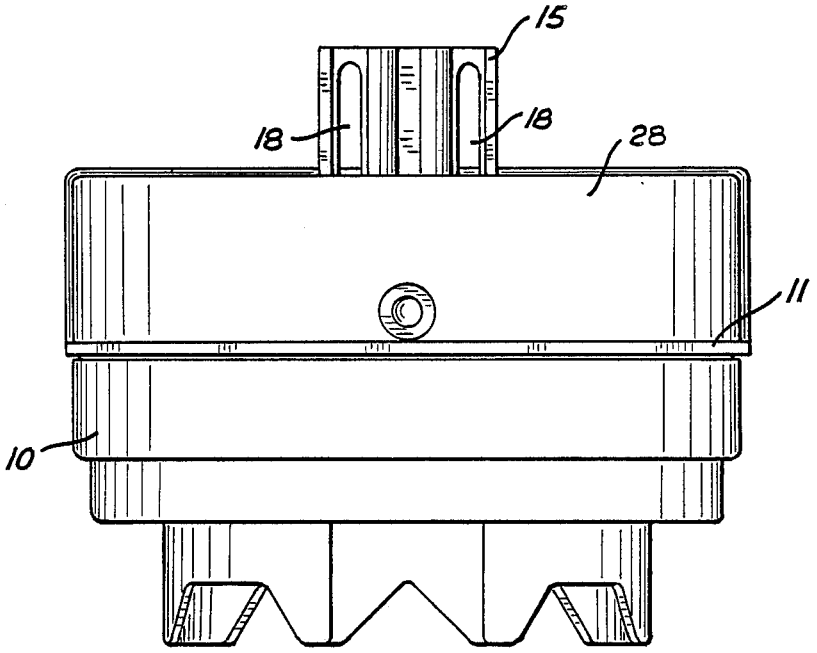
FIG. 5 is a plan view of the assembly shown in FIG. 1.
Figure 6:
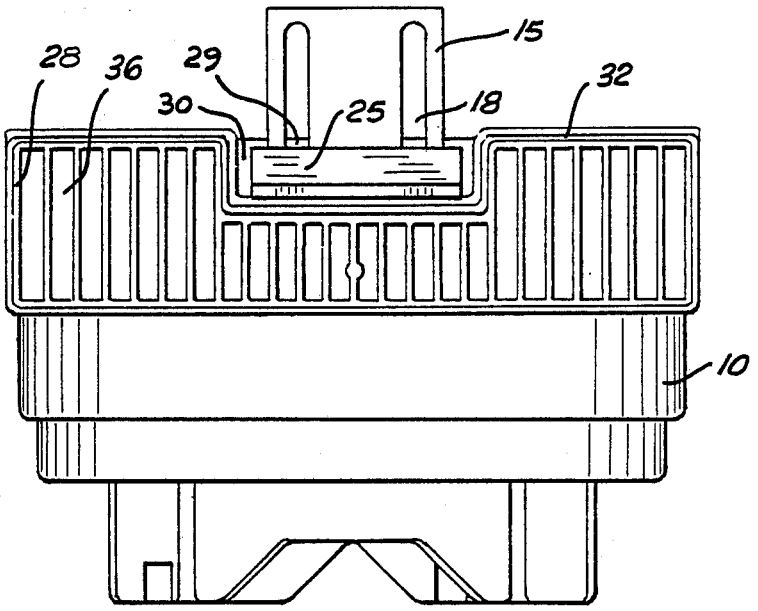
FIG. 6 is an underside view of the assembly shown in FIG. 1.
Figure 7:
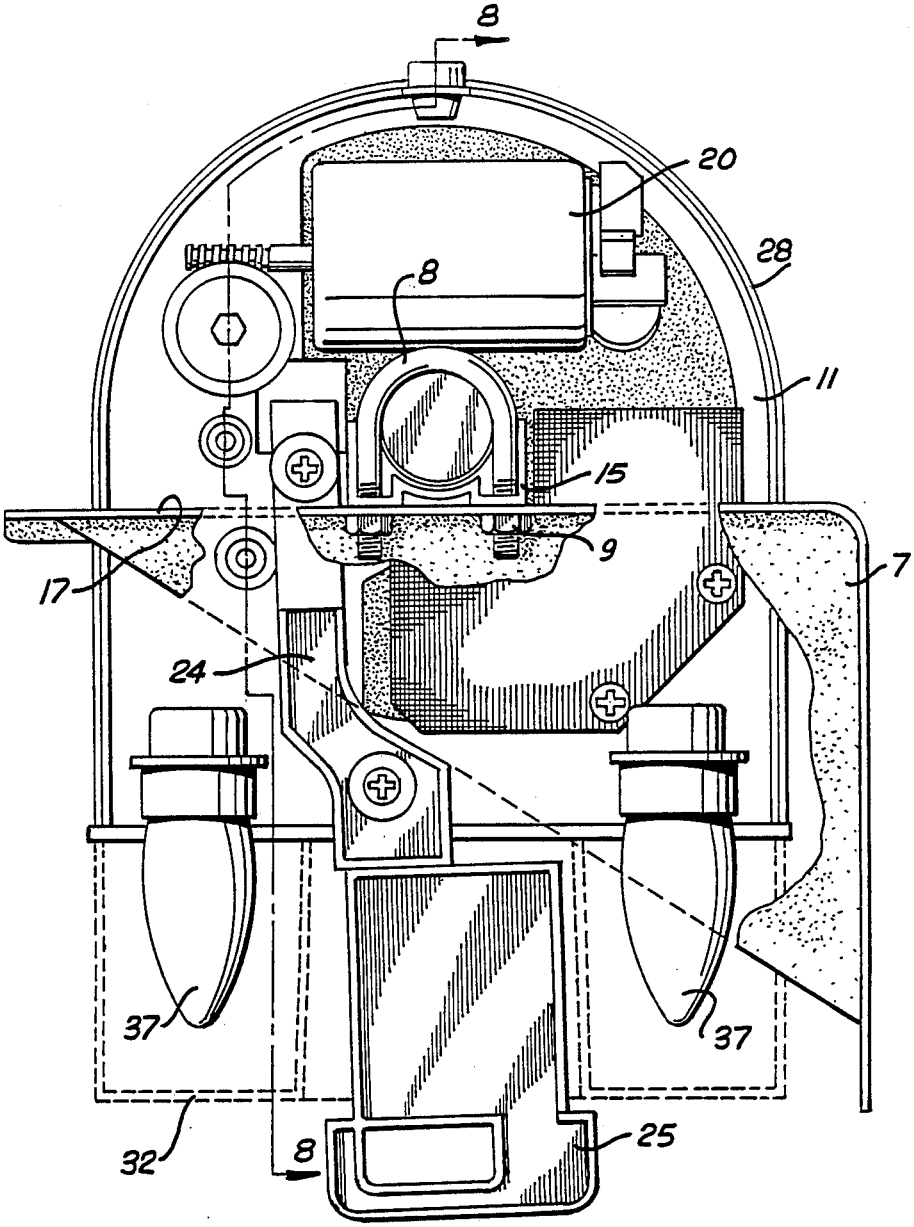
FIG. 7 is a cut-away front elevation of the assembly, showing, it attached to a mounting bracket.

The chassis also supports an electric motor 20 and a drive means 21 which includes a gear train 22 and a clutch 23 for releasing and re-engaging the motor 20 and the ring gear 10. Drive disengagement is effected by a handle 24 which includes a removable hand-grip portion 25. The hand-grip is illustrated in particular detail in FIGS. 10 to 16. Downward movement of the handle into a latched position disengages the drive by actuation of the clutch 23 in a manner described in detail in our co-pending application. The handle is spring loaded into an upper position of drive re-engagement which is effected either by sliding the hand-grip portion to the left in FIG. 7 or by a preferred form of automatic re-engagement upon actuation of the motor 20.

Returning to features more particularly related to the present invention, the drive assembly includes a housing 28 which is stepped inwardly to define a mounting channel 29 extending transversely of the axis 12 and located on the opposite end of the assembly from the ring gear 10. The mounting channel 29 is adapted to receive the top flange 17 of the mounting bracket 7 as best shown in FIG. 8. The mounting lug 15 extends into the mounting channel in a direction parallel to the axis 12 in order to engage the mounting bracket flange 17 as described above.

This arrangement enables the assembly to fit very closely against the mounting bracket as shown in FIG. 8. This permits the unit to be installed in situations where there would be inadequate side clearance for known devices, such as the prior art unit described in Australian specification No. 519,424 mentioned above. The improved width saving is of the order of the axial width of the mounting bracket. Where necessary, the projecting mounting lug and axle can be cut off flush with the edge of the mounting bracket and need not protrude as shown in FIG. 8.

Preferably, the mounting lug 15 is integral with the chassis and the housing is formed as a separate, removable unit. In other embodiments the housing may be integral with the chassis.

In a preferred form of the invention, the housing also defines a handle channel 30 which extends at right angles to both the mounting channel 29 and the axis 12. The hand grip unit 25 nests within the lower portion 31 of the handle channel 30 for movement therealong.

Preferably, the handle channel is centrally located as shown. This permits the drive assembly to be used in both left hand and right hand installations.

The housing 28 also includes a removable translucent lamp housing 32 which defines the lower portion 31 of the handle channel 30. Upon removal of the lamp housing 32, the hand grip unit 25 can be removed from the handle shank by rotating the hand grip about its bayonett mounting stub 33 from which it can then be downwardly withdrawn.

With the hand grip unit removed or at least rotated out of register with the handle channel 30, easy access is provided to the mounting bolts 9 for situations of reduced side clearance where it would otherwise be awkward to reach the nuts.

The housing also includes upper and lower vents 35 and 36 respectively for ventilating indicator lamps 37. The mounting channel 29 assists this ventilation.

Although the invention has been described with reference to a specific example, it will be appreciated by those skilled in the art that the invention may be embodied in many other forms.

We claim:

1. An improvement in a rolling door drive and mounting assembly of the type comprising a chassis, a final drive unit rotatably mounted to the chassis about an axis of rotation for driving connection to a door for rolling the door about a door mounting axle, a motor fixed with respect to said chassis and drive means interconnecting said motor and said final drive unit; the improvement comprising:

(a) a housing means enclosing at least part of the drive assemble;

(b) a recessed channel in said housing means at a location remote from the final drive unit and adapted to receive at least part of a mounting bracket for mounting the assembly adjacent the door axle; and (c) mounting means extending from said assemble and into the mounting channel in a direction parallel to said axis of rotation of the final drive unit for receiving and supporting the mounting axle of the roller door and for attachment to said part of said mounting bracket in said channel.

2. The improvement in a rolling door drive and mounting assembly according to claim 1 further including a clutch for releasing and reengaging said motor and said final drive unit, handle means for manually operating said clutch, said housing means defining a handle channel extending at right angles to both said mounting channel and said axis, at least part of said handle channel being adapted to receive said handle means for movement within said handle channel.

3. The improvement in a rolling door drive and mounting assembly according to claim 2 wherein said handle channel is centrally located to intersect said axis, thereby to permit said assembly to be used in both left hand and right hand installations.

4. The improvement in a rolling door drive and mounting assembly according to claim 3 wherein said handle means includes a hand grip unit which is movably attached to the handle means for movement out of register with said handle channel, thereby permitting access to said mounting means along said handle channel.

5. The improvement in a rolling door drive and mounting assembly according to claim 4 wherein said grip unit is removably mounted to said handle means with a bayonet connection.

6. A rolling door drive assembly comprising a chassis, a final drive unit rotatably mounted to said chassis about an axis of rotation for operating said door, a motor fixed with respect to said chassis, drive means interconnecting said motor and said final drive unit, housing means defining a mounting channel on said assembly remote from said final drive unit, said mounting channel extending transversely to the axis of rotation of said final drive unit and adapted to receive part of a mounting bracket on which said assembly is to be mounted, mounting means extending into said mounting channel in a direction parallel to said axis for engagement with said part of said mounting bracket.

7. The improvement in a rolling door drive and mounting assembly according to claim 6 wherein said mounting means comprises a mounting lug, said lug being integral with said chassis.

* * * * *